United States Patent [19]

Owens

[11] 3,999,317

[45] Dec. 28, 1976

[54] CREDENTIAL DISPLAY HOLDERS

[76] Inventor: John C. Owens, 1611 17th St., Bedford, Ind. 47421

[22] Filed: Oct. 17, 1975

[21] Appl. No.: 623,357

Related U.S. Application Data

[63] Continuation-in-part of Ser. No. 488,973, July 16, 1974, Pat. No. 3,931,688.

[52] U.S. Cl. ..... 40/1.5; 40/10R; 150/39

[51] Int. Cl.[2] ..... A44C 3/00

[58] Field of Search ..... 40/1.5, 10 R, 129 A, 40/10 D, 158 R, 159, 124.2, 124; 150/39, 35, 34, 40; 206/37–39; 224/26 D, 26 R

[56] References Cited

UNITED STATES PATENTS

| | | | |
|---|---|---|---|
| 1,558,213 | 10/1925 | Atkins | 224/26 D |
| 1,715,752 | 6/1929 | Griffin et al. | 150/39 X |
| 2,238,332 | 4/1941 | Lyman | 150/39 X |
| 3,068,923 | 12/1962 | Wolf | 150/39 X |
| 3,647,056 | 3/1972 | Jacobson et al. | 206/38 R X |
| 3,734,155 | 5/1973 | Stenger | 150/39 |

*Primary Examiner*—John F. Pitrelli
*Attorney, Agent, or Firm*—Robert Brown, Jr.

[57] ABSTRACT

A credential holder adapted to display identification data while worn upon an upper horizontally disposed border or selvage of an upright garment layer, or to display the data while manually held. The holder is composed of three flat data-bearing rectangular panels which, when unfolded, has an L-shaped outline. The panels of the unfolded holder are selectively foldable one upon the other to several laminated positions in each of which at least the data face of one of the panels is exposed to view. The three panels also may be folded into a compact package in which all of the data faces are concealed.

The holder is further characterized by the provision of a detachable supplemental folder laterally adjustable and coincidable with the fold lines of the panels.

1 Claim, 11 Drawing Figures

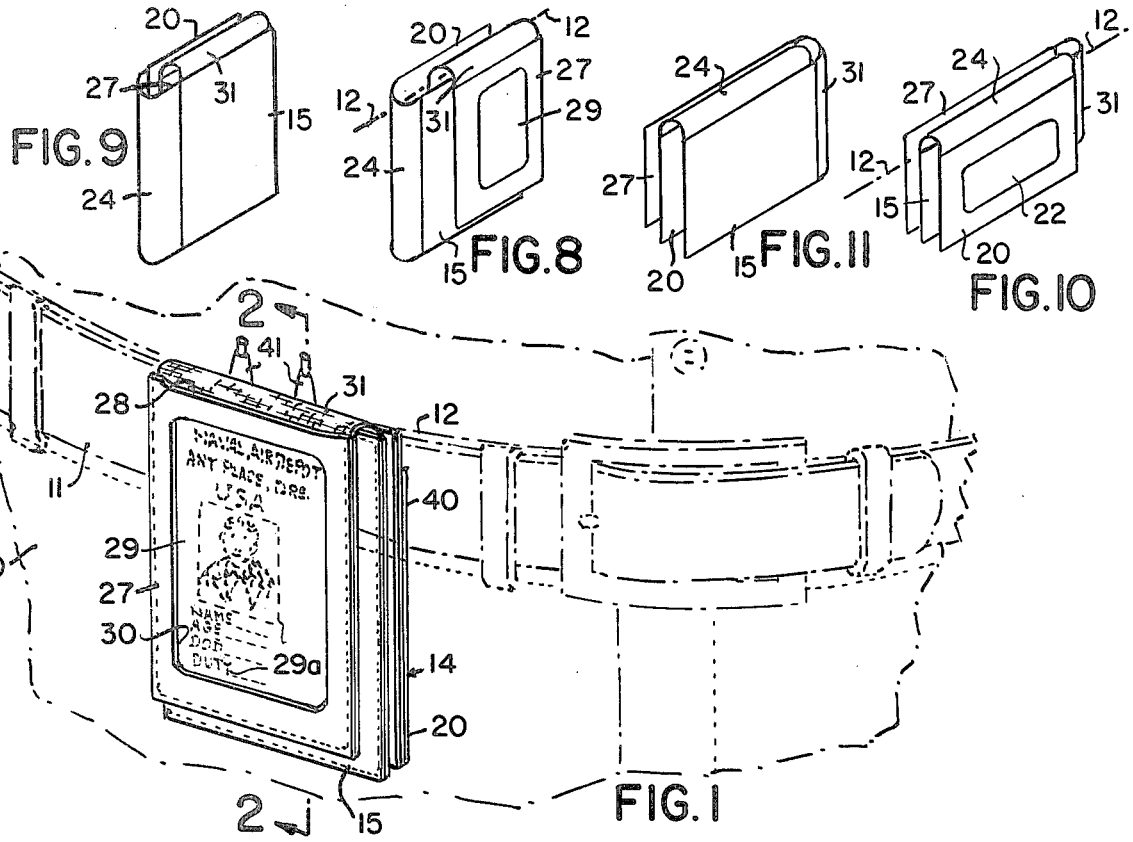
FIG. 9
FIG. 8
FIG. 11
FIG. 10
FIG. 1
NAVAL AIRDEPOT
ANY PLACE, ORE.
U.S.A.
NAME
RANK
DOB
DUTY
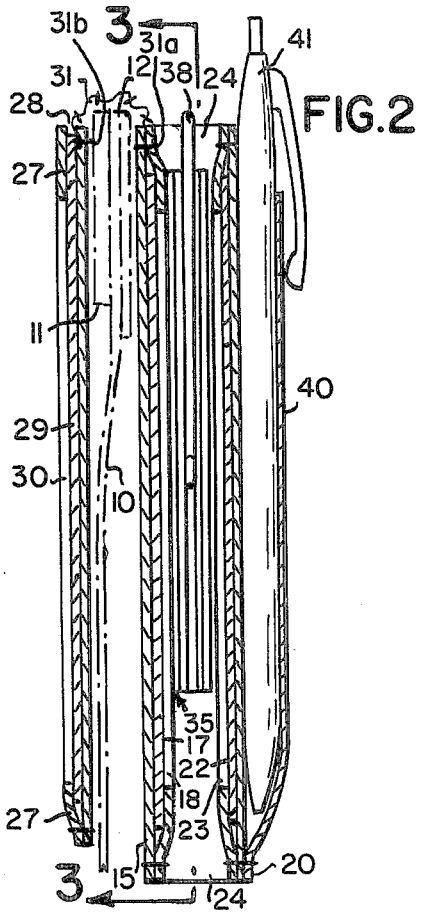
FIG. 2
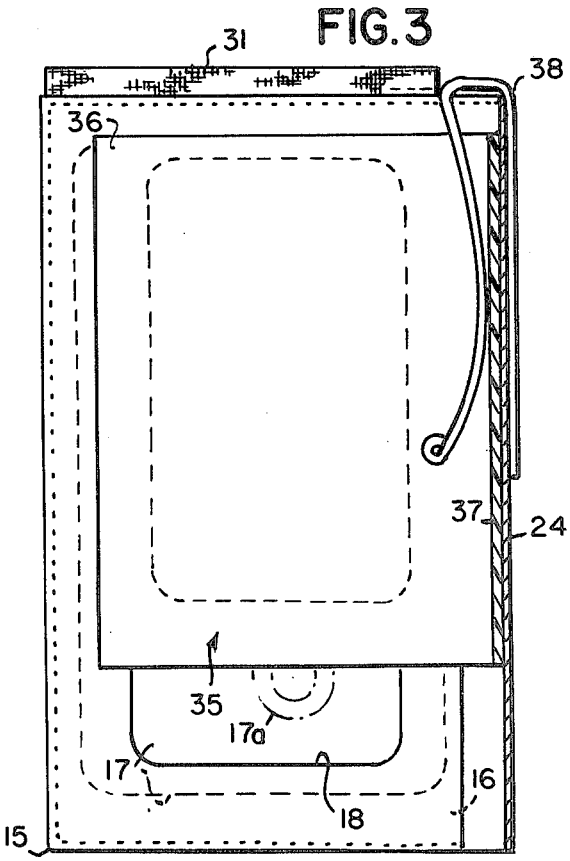
FIG. 3

INSERT THIS END
THE ELECTRONIC KEY
PHONE
NAME
AGE
NAVAL AIR DEPOT
ANYPLACE, ORE.
USA
INCORPORATED
TOTAL
6
5
7

CREDENTIAL DISPLAY HOLDERS

This invention is a continuation-in-part of my copending patent application Ser. No. 488,973, filed July 16, 1974 and issued as U.S. Pat. No. 3,931,688 on Jan. 13, 1976. More particularly, the invention relates to a credential display holder composed of a flat base panel having a pair of flat hinged panels foldable thereupon in overlapping relation with one another respectively about transversely disposed axes, at least one of the hinged panels bearing identification data which is concealed when the holder is folded to carrying position and displayed when the holder is unfolded to a predetermined display position.

It is an object of this invention to provide a display holder of the class described for use by public and private officials, security agents, investigators, toy manufacturers, and numerous other categories of users who may wish to quickly expose or conceal identification datum without risk of loss or misplacement occasioned by separation of parts.

It is another object of invention to provide a credential holder comprising a rectangular base panel having a pair of display panels foldable inwardly thereupon and about two adjacent sides of the base panel to form a compact triple-panel package for carrying purposes, at least one of the display panels having a data-bearing face and which is reversely unfoldable to back-to-back position relative to the base panel to expose the data face to view.

It is another object of invention to provide the credential holder described in the immediately preceding paragraph wherein each of the display panels has a data-bearing face which may be selectively unfolded to exposed position while concealing the other display panel data face.

It is a further object of invention to provide a credential holder of the class described, in combination with a supplemental folder having a fold line coincidable with and laterally adjustable relative to the fold line of the holder.

It is yet another object of the invention to provide a credential holder embodying the above-mentioned characteristic features and which is attractive in appearance, compact, simple in construction, relatively inexpensive to manufacture, and highly efficient in use.

Some of the objects of invention having been stated, other objects will appear as the description proceeds when taken in connection with the accompanying drawings, in which, FIG. 1 is an isometric view of a credential holder according to my invention and mounted in display position upon a wearer's garmet;

FIG. 2 is an enlarged vertical sectional view taken along line 2—2 in FIG. 1;

FIG. 3 is a vertical sectional view taken along line 3—3 in FIG. 2;

FIG. 8 is a schematic isometric view similar to FIG. 1, but showing only the three principal panels to the holder, one of which is mounted in unfolded display position;

FIG. 9 is an isometric view similar to FIG. 8, but showing the holder in folded carrying position;

FIG. 10 is an isometric schematic view wherein another display panel of FIGS. 8 and 9 is mounted in data displaying position, and FIG. 11 is a view similar to FIG. 10, but showing the panels in folded carrying position.

Figures 4, 5, 6, 7:
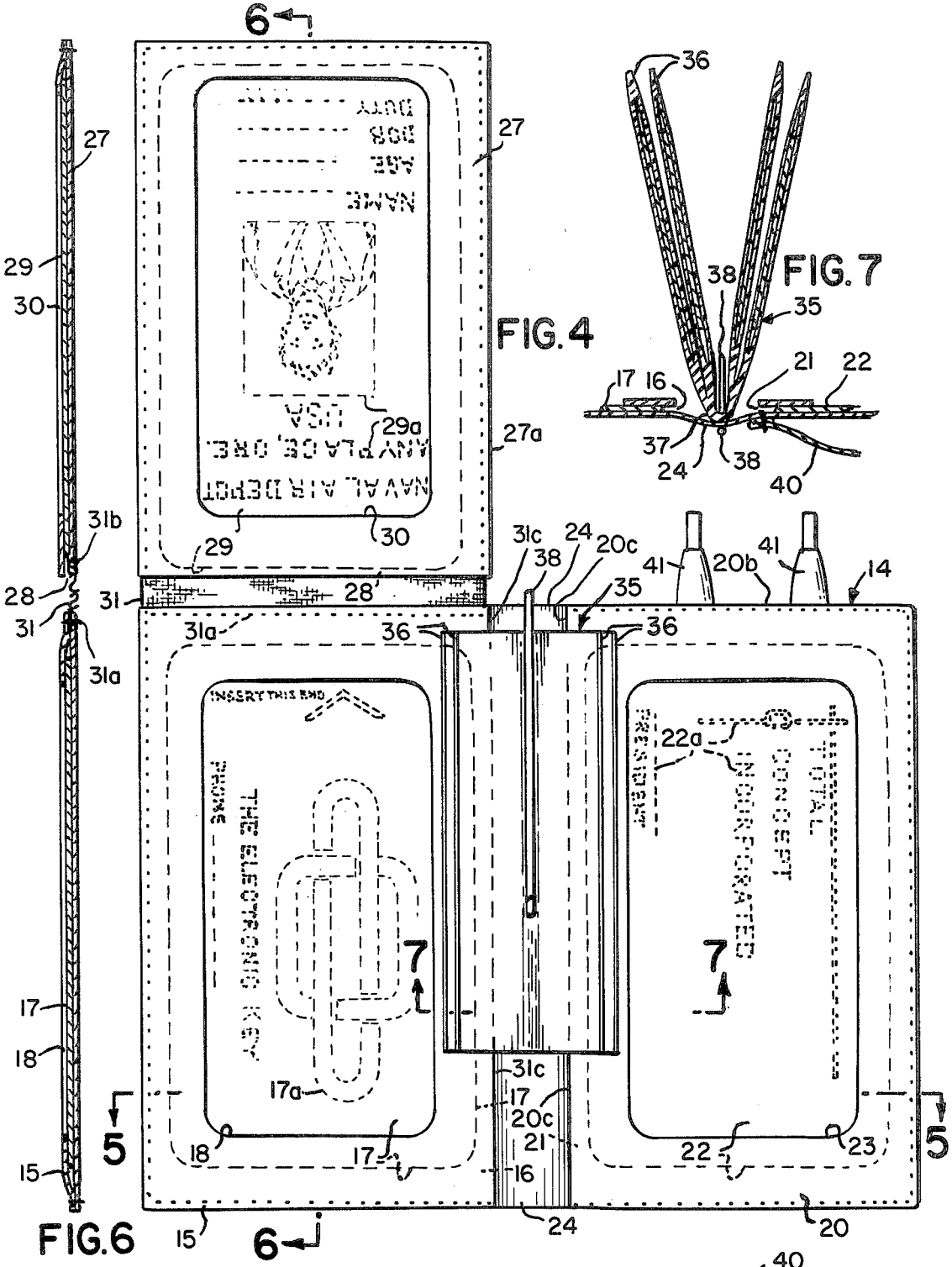
FIG. 4 is a plan view looking at the inside face of the holder when unfolded upon a flat surface.
FIG. 5 is a sectional view taken along line 5—5 in FIG. 4.
FIG. 6 is a sectional view taken along line 6—6 in FIG. 4.
FIG. 7 is a detail sectional view taken along line 7—7 in FIG. 4.

Referring more specifically to the drawings, the numeral 10 denotes the front panel of a garment having a belt 11 therearound. The substantially horizontal upper border 12 of the panel, including the belt, serves as a support upon which the invention may be mounted to display identification data as hereinafter described. It is to be understood that the invention may be used on garment pockets or manually used as conditions may require.

Briefly stated the holder may be limited to a substantially flat L-shaped member 14 consisting of three connected panels, namely, (1) a flat rectangular base panel 15 having a pocket 16 in which an identification card 17 is removably mounted, said pocket being provided with a window or display face 18 through which certain identification data 17*a*, such as insignia, signs, designs and indicia on the card face, may be viewed; (2) a first display panel 20 having a pocket 21 in which an identification card 22 is removably mounted, this pocket also being provided with a window or display face 23 through which the data 22*a* on the card face may be viewed, said panel 20 being hingedly connected to rectangular base panel 15 by means of a flexible fold or bend strip 24, and (3) a panel 27 having a pocket 28 in which an identification card 29 is removably mounted and provided with a window or display face 30 through which the data on the card may be viewed, the panel 27 being hingedly connected by a flexible strip 31 to a side of base panel 15 which is adjacent the side to which the first display panel 20 is hinged. Strip 31 has its opposite sides secured to panels 15 and 27 as at 31*a* and 31*b* by any suitable means such as adhesive or stitching, whereas strip 24 has its opposite sides secured to panels 15 and 20 as at 31*c* and 20*c* as an integral part of the panels, the axes of hinge strips 31 and 24 being disposed substantially at right angles to one another. Each of the strips 31 and 24 is reversibly bendable about its axis from one U-shape to an opposite-hand U-shape.

Since the adjacent sides 31*a* and 31*c* of panel 15 are disposed at right angles to one another and the adjacent sides 20*b* and 20*c* of panel 21 are similarly disposed, the sides 31*a* and 31*c* will coincide respectively with sides 20*b* and 20*c* when the panels 15 and 20 are folded about hinge strip 24 to closed position. Similarly, the adjacent sides 31*b* and 27*a* will coincide with adjacent sides 31*a* and 31*c* when panels 27 and 15 are folded. The above-described coincidable adjacent sides permit the display panels 20 and 27 to be selectively folded to face-to-back and back-to-face positions relative to one another. Moreover, either display panel can swing freely to and from face-to-face position relative to base panel 15 when the other display panel is partially unfolded to a right angular position relative to base panel 15, thereby permitting the display panels to be more quickly folded and unfolded, one at a time. FIG. 9 shows display panel 27 folded back-to-face relative to panel 20, whereas, FIG. 11 shows the display panels folded face-to-back.

When panel 27 is unfolded reversely about hinge strip 31 from its position in FIG. 9 to that in FIGS. 1 and 8, the data 29*a* on the face of card 29 will be exhibited with the garment layer 10 as a background. Of course, the data 29*a* may be exhibited in unfolded position as shown in FIG. 8 while held manually instead of mounted on border 12. When data 29*a* is exhibited on the outer face of garment 10, the holder 14 is supported with the hinge strip 31 resting astride the selvage or upper margin 12 and with panel 27 on the outside and the folded panels 15 and 20 on the inside face of layer 10 as shown in FIGS. 1, 2 and 8. When the data 22*a* on panel 20 is exhibited in a similar manner, the holder is supported with the hinge strip 24 resting astride border 12 and with panel 20 outside and folded panels 15 and 27 inside as shown in FIG. 10.

The holder 14 is provided with a supplemental folder 35 (FIGS. 2, 4 and 7) which consists of a plurality of smaller folds or panels 36 bound together along a back or fold line 37. This supplemental folder is detachably mounted longitudinally upon hinge strip 24, as shown in FIG. 2; however, it may be similarly mounted upon hinge strip 31, but must be shortened so as to remain within the confines of the folded holder. A spring clamp 38 is employed to detachably hold the folder 35 in a position in which its bend line 37 will substantially coincide with the bend axis of the strip upon which it is mounted.

Due to variations in the thickness of the panels of the holder and the supplemental folder under varying conditions of use the axes of strips 31 and 24 about which the panels fold will vary laterally. It is therefore important to note that clamp 38 and the folder 35 may be adjusted laterally of hinge strips to cause the holder panels and supplemental folder panels to fold about a coinciding axis.

If desired, a pocket 40 may be provided on the back of holder panel 20 (FIGS. 2 and 5) to hold small articles such as pencils 41 in an accessible location.

I claim:

1. An L-shaped identification holder in combination with a garment, (14) adapted to be worn in selected display positions upon an upper horizontally disposed border (12) of an upright garment layer of said garment (10), said layer having an outer face and a back, said holder comprising:

a substantially flat rectangular panel (15) forming the apex of said holder and having an indicia display face (18) and a back face, said panel being positioned back-to-face relative to said layer and having a horizontally disposed upper marginal edge (31*b*) and an adjacent vertically disposed marginal edge (31*c*);

a second substantially flat rectangular panel (20) forming one leg of said holder and having an indicia display face (23) and a back face, said panel being positioned face-to-face relative to said first panel (15) and having a vertically disposed marginal edge (20*c*);

means (24) for reversibly hinging said vertically disposed marginal edges (31*c*, 20*c*) of said first and second panels to one another;

a third substantially flat panel (27) forming another leg of said holder and having an indicia display face (30) and a back face, said third panel being positioned back-to-face relative to said layer (10) and provided with a horizontally disposed upper marginal edge (31*b*), the indicia display face of said third panel facing outwardly from said layer (10), and means (31) for reversibly hinging said upper marginal edges (31*a*, 31*b*) of said first and third panels to one another, said last-named means (31) being removably mounted longitudinally astride said border (12) to thereby suspend said first, second and third panels, whereby the holder (14) may be dismounted from said border, said first and third panels folded face-to-face, and said second panel folded back-to-back upon said third panel to thereby conceal the respective panel display faces from view.

* * * * *